US006270120B1

(12) United States Patent
Ong

(10) Patent No.: US 6,270,120 B1
(45) Date of Patent: Aug. 7, 2001

(54) LOCKING SLIDE BAR

(76) Inventor: Bon S. Ong, Box 4247, Torrance, CA (US) 90510

( * ) Notice: Subject to any disclaimer, the term of this patent is extended or adjusted under 35 U.S.C. 154(b) by 0 days.

(21) Appl. No.: 09/660,233

(22) Filed: Sep. 12, 2000

(51) Int. Cl.[7] ..... B42D 1/00

(52) U.S. Cl. ..... 281/15.1; 281/21.1; 281/28; 281/29; 402/8; 402/17

(58) Field of Search ..... 402/45, 46, 74, 402/80 R, 79, 73, 17–19; 281/15.1–21.1, 29, 36, 38, 28

(56) References Cited

U.S. PATENT DOCUMENTS 5,727,816 * 3/1998 Ong ..... 281/21.1 X
5,865,469 * 2/1999 Chin ..... 281/21.1 X
5,941,569 * 8/1999 Solomons ..... 281/21.1
5,947,524 * 9/1999 Podosek ..... 281/21.1 X

* cited by examiner

*Primary Examiner*—Willmon Fridie, Jr.
(74) *Attorney, Agent, or Firm*—Charles H. Thomas

(57) ABSTRACT

A document formed of a stack of papers bound at the spine is equipped with a slide bar that achieves locking engagement with a document binder without requiring an extra die cutting step in its manufacture. The document binder is formed of articulated panels, one of which is a narrow margin panel having a width no greater than the width of the binding margin of the stack of papers. The slide bar has a pair of jaws that terminate in hooked lips that face each other across a gap defined between the jaws. The slide bar is inserted into the binding edge of the stack of papers in a direction parallel to the binding edge from either the top or bottom end of the stack. The narrow margin panel atop the binding edge margin fits within and is captured by the hooked lip of the clasp jaw adjacent thereto throughout its length and throughout the length of the binding edge of the stack of papers. The positive locking interengagement of the narrow binding margin panel in the hooked lip prevents the slide bar from being pulled laterally off of the binding edge of the stack.

16 Claims, 3 Drawing Sheets

LOCKING SLIDE BAR

BACKGROUND OF THE INVENTION

1. Field of the Invention

The present invention relates to a locking slide bar or clasp of the type used to form a stiff spine for reports, presentations, and other stacks of paper assembled and bound together.

2. Description of the Prior Art

Plastic spines or slide bars for use in gripping the binding edges of stacks of papers together, such as reports, proposals, briefs, and other stacks of documents fastened together along a common edge have been manufactured for many years. Conventional report cover grips or slide bars of this type are manufactured as extruded plastic structures of uniform cross section throughout. Conventional slide grips are formed with a pair of jaws joined together at a common base and forming an open slot or gap therebetween. The jaws are laterally elongated so as to extend the entire length of the binding edge of the stack of papers. The gap between the jaws is narrow enough so that they must be forced apart slightly to accommodate the thickness of the stack of papers. The jaws can be deflected resiliently apart to increase the width of the gap therebetween so as to receive the binding edge of the stack of papers within the gap. When the jaws are released, a clamping force is exerted by the jaws against the stack of papers as the jaws attempt to move toward each other back toward their undeformed positions.

A major problem with conventional slide grips or slide bars of this type is that the gripping force is inadequate to secure the grip on the binding edge of the stack of papers. Quite often when a user opens the report the stress of parting the papers as the pages are opened is transmitted to the slide grip as a force directed outwardly away from the binding edge of the report in a direction perpendicular thereto. As a consequence, the slide grip is pushed laterally away from the binding edge of the report and pops off of the binding of the report. This tendency is aggravated when the report has a clear, slick, glossy cover, such as a clear plastic polypropylene cover of the type frequently used as a report or presentation cover to protect the papers therewithin. The low coefficient of friction on the surface of such a plastic cover makes it extremely easy for a conventional spine gripping bar to pop off of the binding edge of a stack of bound papers.

Attempts have been made to correct this problem. For example, the otherwise conventional sliding bar report cover grip sold by the JM Company located in Hasbrouck Heights, New Jersey has a report cover gripping bar provided with a pair of opposing longitudinal ribs directed toward each other near the bases of the jaws of the grip. The concept is that the additional contact with the cover provided by the ribs will enhance the gripping force provided by the slide bar on the cover. However, this system provides no positive interlocking connection between the slide bar and the report cover so that the report cover grip still slides free from the cover when the report is opened.

The Avery Dennison Company has used a gripping report cover slide bar on which the extremities of the jaws are provided with inwardly directed hooks or tangs. A polyethylene plastic report cover is folded in half and die cut near its longitudinal center fold with a plurality of arcuate, semicircular die cuts spaced periodically along its length to create a number of tabs. The curved surfaces of the semicircular tabs are directed away from the binding center fold and toward the opposite edges of the cover and of the stack of papers encompassed therewithin. However, this system still has several problems. Because the semicircular tabs lie in the same plane as the cover sheet material from which they are cut, the hooked edges of the gripping bar will sometimes fail to engage the semicircular tabs. Also, the die cuts are through both the front and back cover of the folded polyethylene cover sheet and must be spaced quite closely to the center fold line in order to be engaged by the hooks or tangs at the extremities of the jaws of the gripping bar. There is very little structure left between the front and back die cuts adjacent the fold line. As a consequence, the material can fail at the fold line and the tabs will separate from the remaining structure of the cover as generally circular die cut punch outs.

SUMMARY OF THE INVENTION

The present invention is an improved type of document binding cover grip bar system that overcomes the deficiencies of the prior art. Specifically, the present invention provides a positive interlocking system for preventing a slide gripping bar from pulling free from a document cover which does not require a separate die cutting operation. Furthermore, the system of the present invention is not susceptible to structural failure within a plastic cover.

In one broad aspect the present invention may be considered to be a combination of a plurality of sheets of paper, a document binder, at least one fastener, and a stiff, resilient, elongated channel which engages the document binder. The sheets of paper are disposed one atop another to form a stack having top and bottom sheets and defining a binding edge of the stack. An opposite edge of the stack is parallel to the binding edge while a narrow binding margin on the stack lies adjacent to the binding edge. The document binder is formed of a plurality of panels, including a top binding panel located atop the stack and above the top sheet at the binding margin and a back binding panel located beneath the stack and residing beneath the binding margin. At least one of the binding panels is a narrow panel having a width no greater than the width of the binding margin of the stack. The fastener or fasteners pass through the top and bottom sheets and through the narrow binding panel and emerge from the stack at the binding margin of the stack. The channel-shaped clasp is of uniform cross section throughout and is formed with a pair of jaws joined together and projecting outwardly from their junction to define a gap therebetween. At least one of the jaws terminates in a hooked lip. The binding edge of the stack is inserted into the gap so that the hooked lip is engaged with the narrow panel to restrict relative movement between the clasp and the stack in a direction perpendicular to the binding edge.

Preferably, each of the jaws of the clasp terminates in a hooked lip as described. This prevents a user from engaging the clasp on the binding edge of the stack with the hooked lip on the bottom of the stack and the narrow binding margin panel on the top, or vise versa. Preferably also, the top binding panel is the narrow panel and the back binding panel is a broad back cover that extends from the binding edge of the stack all the way across to the opposite edge of the stack beneath the bottom sheet thereof. With a construction such is this, the document binder may be formed of paper or card stock and a clear, transparent polyethylene cover may be attached to the stack beneath the narrow top binding panel by the same fastening system that passes through the stack and the narrow binding panel. Very typically several wire staples are used as fasteners for this purpose.

The invention may be defined in another way as a combination of a plurality of pages, a binding, a plurality of fasteners and a stiff, resilient, elongated clasp of uniform cross section throughout. The pages are disposed one atop another to form a stack having top and bottom sheets and defining a binding edge of the stack. An opposite edge of the stack is parallel to the binding edge. The stack has a narrow binding margin adjacent to the binding edge. The binding includes a plurality of face panels respectively overlying the top and bottom sheets of the stack. The face panels are joined together by at least one spine fold located at and parallel to the binding edge of the stack.

At least one of the face panels is a narrow margin panel that extends the length of the binding margin and is limited in width so that it extends no further toward the opposite edge of the stack than the binding margin. The narrow margin panel thereby defines an inboard boundary proximate the binding margin. The fasteners extend through the narrow margin panel and through the stack located between the face panels at the binding margin. The fasteners are located between the spine fold or fold that joins the face panels and the inboard edge of the margin panel. The clasp is formed as a channel-shaped structure having a pair of opposing jaws that have mutually facing surfaces which define a slot opening therebetween. At least one of the jaws terminates in an inwardly turned hooked lip. The clasp is disposed to capture the binding therewithin, whereby the hooked lip of the clasp engages the inboard boundary of the margin panel. The clasp is thereby held on the binding edge of the stack by the positive engagement that exists between the hooked lip of the clasp and the inboard boundary of the binding.

The invention may be described with greater clarity and particularity by reference to the accompanying drawings.

DESCRIPTION OF THE EMBODIMENT

Figure 1:
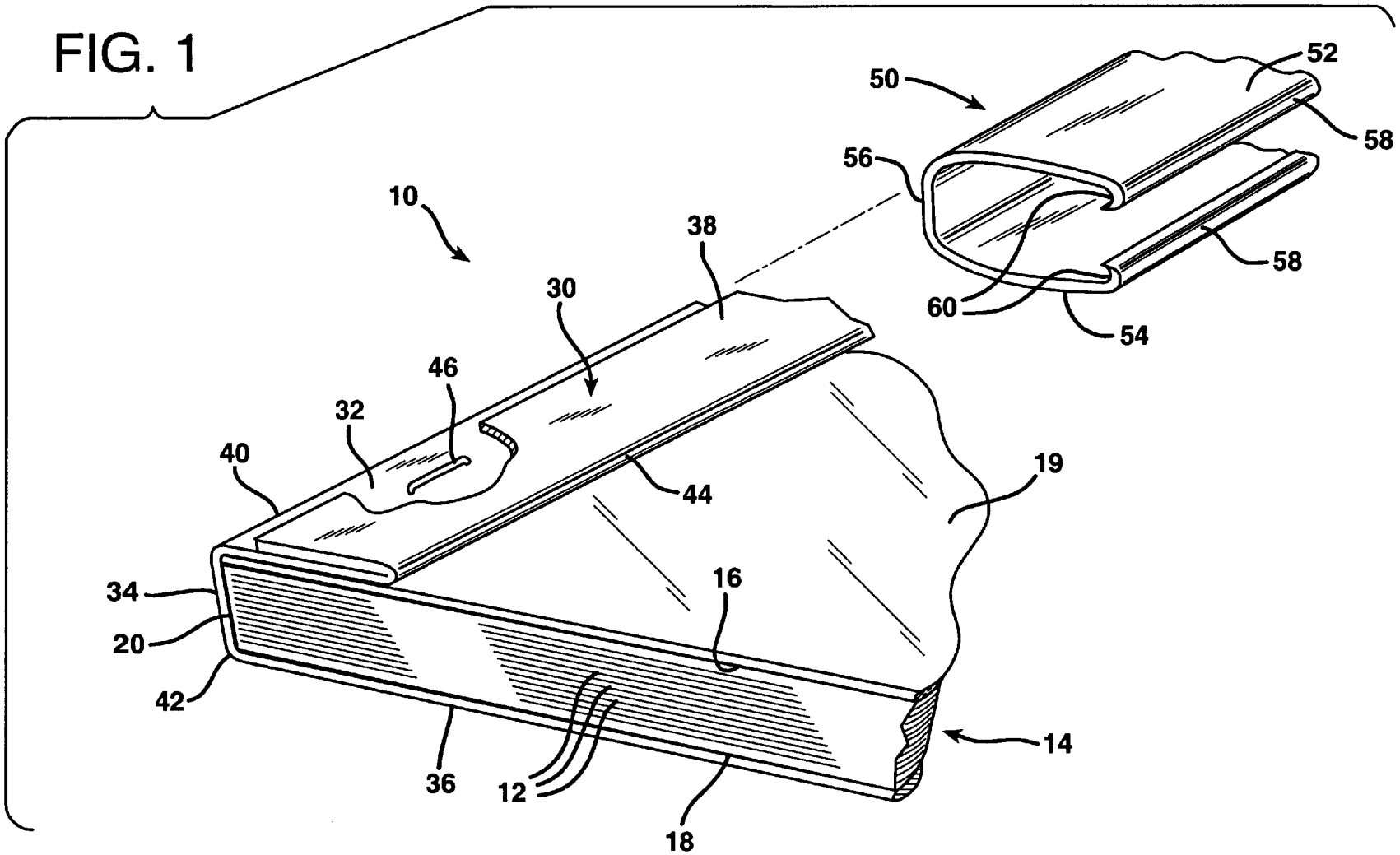
FIG. 1 is a perspective view illustrating one preferred embodiment of a locking slide bar document binding system according to the invention.
Figure 2:
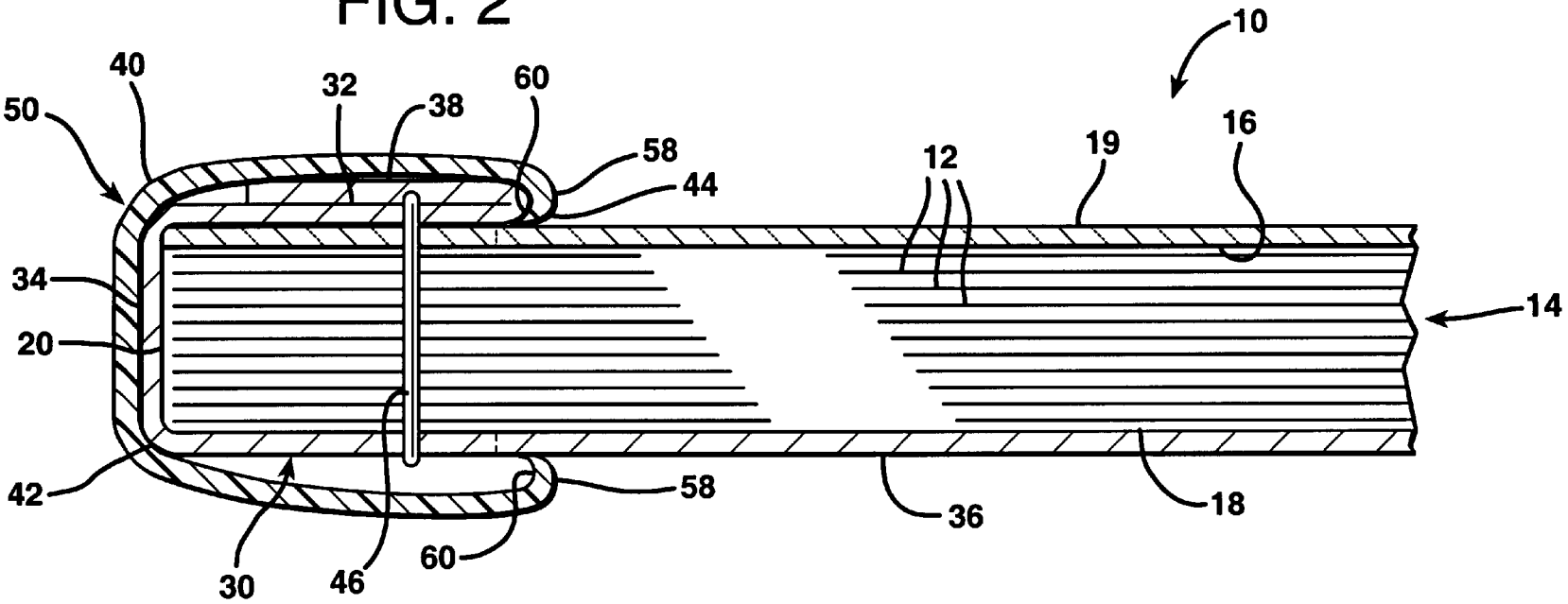
FIG. 2 is a sectional elevational view illustrating the document binding system of FIG. 1.
Figure 3:
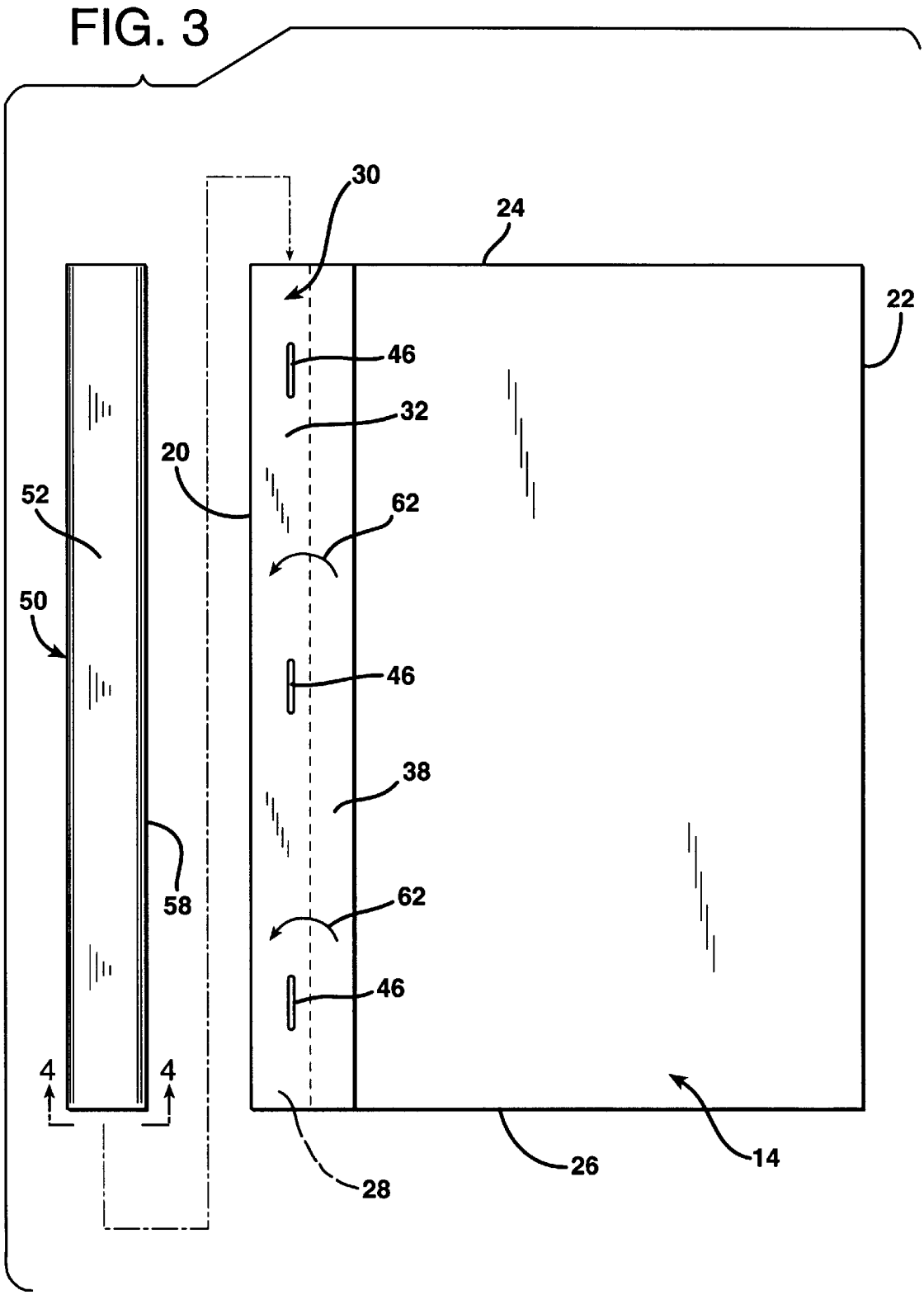
FIG. 3 illustrates the method of assembling the document binding combination shown in FIGS. 1 and 2.

FIGS. 1, 2, and 3 illustrate the combination of the invention generally at 10. The combination 10 is comprised of a plurality of rectangular sheets of paper 12 disposed one atop another to form a stack of papers indicated generally at 14. The paper sheets 12 may have, for example, a width of eight and one-half inches and a length of eleven inches. The paper stack 14 has a top sheet 16 and a bottom sheet 18. A transparent or opaque cover sheet 19 is positioned upon the top sheet 16. The stack of papers 14 defines a binding edge indicated at 20 and an opposite edge 22 which is parallel to the binding edge 20. The paper stack 14 also has an upper edge 24 and an opposite lower edge 26. The stack 14 also defines a narrow binding margin 28 which may, for example, be about one-half an inch in width. The binding margin 28 is adjacent to the binding edge 20 of the stack 14.

The combination 10 also includes a document binder 30 which may be formed of heavy paper or card stock. The binder 30 is formed of a plurality of articulated panels, including a narrow top binding margin panel 32, a spine panel 34, a broad back cover binding panel 36 and a narrow return binding panel 38. The narrow top binding margin panel 32 is located atop the top sheet 16 of the stack 14 and resides in contact with the binding margin 28 of the stack 14. The broad back binding panel 36 extends from the binding edge 20 of the stack 14 all the way across to the opposite edge 22 of the stack 14 beneath the bottom sheet 18 of the stack of papers 14.

The spine panel 34 is interposed between the narrow top binding margin panel 32 and the back binding panel 36 and is joined thereto and delineated therefrom by separate spine folds 40 and 42, respectively. The narrow binding return panel 38 is joined to the narrow top binding panel 32 at a return fold 44. The return panel 38 projects from the return fold 44 back toward the binding edge 20 of the stack 14, thereby at least partially covering the narrow top binding panel 32. The spine folds 40 and 42 and return fold 44 extend longitudinally the entire length of the stack 14 parallel to the binding edge 20 so that the binder 30 envelopes the binding edge 20 of the stack 14 throughout its length.

The top binding margin panel 32 is limited in width so that it extends no further toward the opposite edge 22 of the stack 14 than the binding margin 28. The inboard boundary of the top binding margin panel 32 formed by the longitudinal fold 44 is located proximate the binding margin 28 of the stack 14 and only about one-half an inch from the binding edge 20 of the stack 14.

The combination 10 also has a plurality of fasteners which, in the embodiment shown, are the three wire staples 46 illustrated in drawing FIGS. 1, 2, and 3. The staples 46 extend through the narrow top binding margin panel 32 and through the stack 14 of papers 12 located between the top face binding margin panel 32 and the bottom face panel 36. The staples 46 are located at the binding margin 28 and extend through the narrow, top binding margin panel 32 between the spine fold 40 and the inboard boundary of the narrow, top binding margin panel 32 formed by the return fold 44. The staples 46 pass through the top binding margin panel 32 and completely through all of the pages 12 in the stack 14, and through the back binding panel 36, but not necessarily through the return panel 38. Preferably, the staples 46 are located about half way across the width of the binding margin 28, about one-quarter of an inch from the binding edge 20 of the stack 14. The staples 46 are spaced longitudinally apart from each other along the length of the binding margin 28 of the stack 14. A stapled report cover of the type employed in the combination 10 and illustrated in the drawings is described more fully in U.S. Pat. No. 5,727,816.

Figure 4:
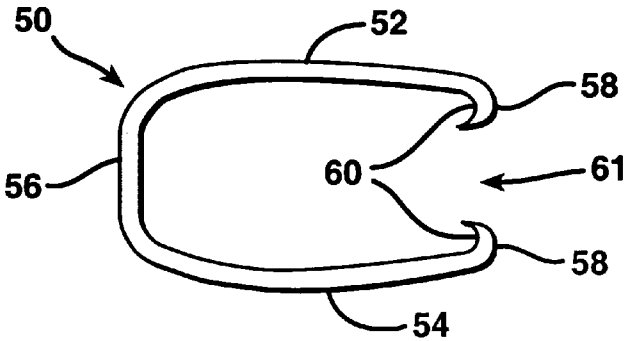
FIG. 4 is an end view of the clasp utilized in the combination of the invention shown in isolation.

The combination 10 also employs a stiff, resilient, elongated clasp 50 which may be formed as an extrusion of polyvinyl chloride or another plastic which is cut to length. The clasp 50 is configured with a pair of opposing jaws 52 and 54 that are joined together at their respective bases by a spine section 56. The spine section 56 spans the distance between the top sheet 16 and the bottom sheet 18 of the stack of papers 14. The jaws 52 and 54 project outwardly from the spine section 56 and both terminate in hooked lips 58 which face each other across the slot opening 61 defined between the jaws 52 and 54, as best illustrated in FIG. 4. As illustrated in FIGS. 2 and 4, the tip of each hooked lip 58 is turned back and points toward the spine section 56 to define a crevice or groove 60.

FIG. 3 illustrates the manner of assembly of the clasp 50 with the stapled report in which the report cover 30 is stapled to the stack of papers 14 to create the combination 10. The clasp 50 is positioned near either the top edge 24 or the bottom edge 26 of the stack papers 14. The paper structure forming the cover 30 is folded along the return fold line 44 as illustrated by the directional arrows 62 to create a demarcation or boundary edge to the narrow top cover panel 32. The jaws 52 and 54 of the clasp 50 are then flexed slightly apart adjacent the end of the stack 14 at which the clasp 50 is to be inserted over the cover 30.

The clasp 50 is then pushed along the binding edge 20 of the stack 14, whereupon the folded over return panel 38 and the top cover panel 32 are both engaged at the return fold 44 in the crevice 60 by the hooked lip 58 of the upper jaw 52, as illustrated in FIG. 2. The clasp 50 is then pushed all the way along the length of the stack 14 so that the ends of the clasp 50 are in registration with the top and bottom edges 24 and 26 of the stack 14. When assembled in this manner the clasp 50 is firmly engaged with the cover 30 by virtue of the positive, interlocking, interengagement of the demarcation edge 44 of the narrow, top cover panel 32 in the crevice 60 of the upper jaw 52 of the clasp 50. As is evident from FIG. 2, the clasp 50 will resist separation from the stack 14 even though a significant lateral or transverse force of separation is applied against the clasp 50 toward and perpendicular to the binding edge 20 of the stack 14 due to the engagement of the return fold 44 in the crevice 60.

Undoubtedly, numerous variations and modifications of the invention will become readily apparent to those familiar with office products. For example, the clasp 50 will engage the top panel 32 even if there is no return panel 38. In such an embodiment the cut edge of the narrow top cover panel 32 will still be captured in interlocking engagement with the crevice 60. Also, the system will still provide a positive interlocking engagement if the narrow cover panel at the binding margin 28 is the bottom panel lying adjacent the bottom sheet 18, rather than the top panel. Also, a different type of fastening system, such as a prolonged fastener, could be substituted for the staples 46. Other variations in construction are also possible. Accordingly, the scope of the invention should not be construed as limited to the specific embodiment depicted and described, but rather is defined in the claims appended hereto.

What is claimed is:

1. In combination, a plurality of rectangular sheets of paper having mutually parallel upper and lower edges disposed one atop another to form a stack having top and bottom sheets and defining a binding edge of said stack, an opposite edge of said stack parallel to said binding edge, and a narrow binding margin on said stack adjacent to said binding edge;

a document binder formed of a plurality of panels including a top binding panel located atop said stack above said top sheet at said binding margin and a back binding panel located beneath said stack and residing beneath said binding margin, and wherein at least one of said binding panels is a narrow panel having a width no greater than the width of said binding margin in said stack and having a demarcation edge extending the entire distance between said upper and lower edges of said plurality of sheets of paper;

at least one fastener passing through said top and bottom sheets and through said narrow binding panel and emerging from said stack at said binding margin of said stack; and a stiff, resilient, elongated channel-shaped clasp of uniform cross section throughout formed with a pair of jaws joined together and projecting outwardly from their junction to define a gap therebetween, and at least one of said jaws terminates in a hooked lip that extends the entire length of said clasp, and said binding edge of said stack is inserted into said gap so that said hooked lip is engaged throughout its length with said narrow panel to restrict relative movement between said clasp and said stack in a direction perpendicular to said binding edge.

2. A combination according to claim 1 wherein each of said jaws of said clasp terminates in a hooked lip as aforesaid.

3. A combination according to claim 1 wherein said document binder is further comprised of a binder spine panel interposed between said top and back binding panels and joined thereto by spine folds, and a binding return panel joined to said narrow binding panel at a return fold and projecting from said return fold back toward said binding edge of said stack, thereby at least partially covering said narrow binding panel.

4. A combination according to claim 1 wherein said document binder is further comprised of a binding return panel joined to said narrow binding panel at a return fold and projecting from said return fold back toward said binding edge of said stack, thereby at least partially covering said narrow binding panel.

5. A combination according to claim 1 wherein said top binding panel is said narrow panel and said back binding panel is a broad back cover and extends from said binding edge of said stack all the way across to said opposite edge of said stack beneath said bottom sheet thereof.

6. A combination according to claim 1 further comprising a plurality of fasteners as aforesaid, and said fasteners are staples spaced from each other along said binding margin of said stack.

7. A combination according to claim 1 wherein said clasp is formed with a spine that joins said jaws together and said jaws project outwardly from said spine and said spine spans the distance between said top and bottom sheets of said stack.

8. In combination, a plurality of rectangular pages having mutually parallel upper and lower edges disposed one atop another to form a stack having top and bottom sheets and defining a binding edge of said stack, an opposite edge of said stack parallel to said binding edge, and a narrow binding margin on said stack adjacent to said binding edge, a binding for said stack including a plurality of face panels respectively overlying said top and bottom sheets of said stack and joined together by at least one spine fold located at and parallel to said binding edge of said stack, and at least one of said face panels is a narrow margin panel that extends the length of said binding margin and is limited in width so that it extends no further toward said opposite edge of said stack than said binding margin and thereby defines an inboard boundary proximate said binding margin that extends the entire distance between said upper and lower edges of said pages, a plurality of fasteners extending through said narrow margin panel and through said stack at said binding margin and said fasteners are located between said at least one spine fold and said inboard boundary of said margin panel, and a stiff, resilient, elongated clasp of uniform cross section throughout and formed as a channel-shaped structure having a pair of opposing jaws that have mutually facing surfaces which define a slot opening therebetween, and at least one of said jaws terminates in an inwardly turned hooked lip that extends the entire length of said clasp, and said clasp is disposed to capture said binding therewithin, whereby said hooked lip of said clasp engages said inboard boundary of said margin panel, thereby holding said clasp on said binding edge of said stack.

9. A combination according to claim 8 wherein both of said jaws of said clasp are provided with hooked lips, and said hooked lips face each other across said slot opening.

10. A combination according to claim 8 wherein said document binder includes a spine panel that is delineated from each of said top and bottom binding panels by a separate spine fold as aforesaid.

11. A combination according to claim 8 wherein said binding is further comprised of the narrow return panel that is joined to said narrow margin panel by a return fold at said boundary, and said return panel extends from said boundary across said narrow margin panel back toward said binding edge of said stack.

12. A combination according to claim 8 wherein said fasteners are wire staples.

13. In combination, a plurality of rectangular sheets having mutually parallel upper and lower edges of paper disposed one atop another to form a stack having top and bottom sheets and defining a binding edge of said stack, an opposite edge parallel to said binding edge, and a narrow binding edge margin on said stack adjacent to said binding edge, a document binder formed of a plurality of panels including a top binding panel located atop said stack and residing in contact with said binding margin and a back binding panel joined into said top binding panel by at least one spine fold so as to extend beneath said stack and residing in contact with said binding margin thereof, wherein at least one of said top and back binding panels is a narrow binding panel and is as narrow as said binding margin and terminates in a longitudinal binding margin demarcation adjacent said narrow binding margin and parallel to said binding edge of said stack and extending between said upper and lower edges of said sheets of paper, at least one fastener passing through and emerging from said top and bottom sheets at said binding margin of said stack and through said narrow binding panel between said binding edge of said stack and said longitudinal binding margin demarcation of said narrow binding panel, an elongated document binder clasp configured as a stiff, resilient, channel-shaped structure defining a pair of mutually facing jaws that define a gap therebetween, and wherein at least one of said jaws has a hooked lip that extends the entire length of said clasp, and said binder clasp encompasses said binding edge of said stack and said narrow binding panel of said binding in said gap and between said jaws so that said hooked lip engages said binding margin demarcation throughout the length of said binding margin.

14. A combination according to claim 13 further comprising a plurality of fasteners as aforesaid, and said fasteners are formed as wire staples.

15. A combination according to claim 14 further comprising a spine panel located in articulated fashion between said back binding panel and said top binding panel.

16. A combination according to claim 13 wherein both of said jaws of said clasp are formed with hooked lips that face each other across said gap between said jaws.

* * * * *